United States Patent [19]

Lehtinen

[11] 3,970,513

[45] July 20, 1976

[54] STEAM SUPPLYING STRUCTURE FOR OPPOSING BUILD-UP OF MATTER IN HEADBOXES

[75] Inventor: Antti Lehtinen, Jyvaskyla, Finland

[73] Assignee: Valmet Oy, Helsinki, Finland

[22] Filed: Apr. 9, 1975

[21] Appl. No.: 566,328

Related U.S. Application Data

[63] Continuation-in-part of Ser. No. 529,113, Dec. 3, 1974, abandoned.

[30] Foreign Application Priority Data

Apr. 10, 1974 Finland ..... 1101/71

[52] U.S. Cl. ..... 162/272; 162/322; 162/343; 162/380

[51] Int. Cl.[2] ..... D21F 1/02

[58] Field of Search ..... 162/199, 208, 212, 214, 162/216, 272, 322, 336, 338, 343, 344, 380

[56] References Cited

UNITED STATES PATENTS

| | | | |
|---|---|---|---|
| 2,736,247 | 2/1956 | Hornbostel | 162/343 X |
| 3,005,746 | 10/1961 | Baxter, Jr. | 162/199 |
| 3,122,470 | 2/1964 | Lamb et al. | 162/214 |
| 3,791,918 | 2/1974 | Koskimies et al. | 162/343 |

FOREIGN PATENTS OR APPLICATIONS

| | | | |
|---|---|---|---|
| 419,369 | 11/1934 | United Kingdom | 162/208 |

*Primary Examiner*—Robert L. Lindsay, Jr.
*Assistant Examiner*—Richard V. Fisher
*Attorney, Agent, or Firm*—Steinberg and Blake

[57] ABSTRACT

A structure for keeping clean the interior of the headbox of a paper machine as well as contributing to the homogeneity of the stock flowing through the headbox. At a location in the headbox where there is a tendency for accumulation or build-up of matter such as fibers, fillers, slime, or the like, steam is introduced such as by supplying steam to the interior of a hollow body having a wall provided with passages through which the steam can escape to the exterior of the hollow body into the stock in the headbox.

3 Claims, 3 Drawing Figures

STEAM SUPPLYING STRUCTURE FOR OPPOSING BUILD-UP OF MATTER IN HEADBOXES

CROSS REFERENCE TO RELATED APPLICATION

This application is a continuation-in-part of copending application Ser. No. 529,113, filed Dec. 3, 1974, now abandoned, and entitled "METHOD AND APPARATUS FOR HOMOGENIZING STOCK IN THE HEADBOX OF A PAPER-MANUFACTURING MACHINE".

BACKGROUND OF THE INVENTION

The present invention relates to structure for keeping clean the interior surfaces in the headbox of a paper machine as well as for contributing to the homogeneity of the stock which flows through the headbox.

It is known that there is a tendency for matter such as fibers, fillers, or slime to adhere to and accumulate or build-up at interior surfaces of a headbox of a paper-manufacturing machine. These slime deposits may be of biological or non-biological origin.

The tendency of such contamination to occur in the interior of a headbox of a paper-manufacturing machine depends to a great extent on the design of the headbox, which is to say on the way in which flow velocities of the stock are arranged in different parts of the headbox. It can generally be assumed that locations which are particularly susceptible to contamination by build-up of matter as referred to above are those where the flow of stock is relatively slow as compared to the velocity of flow at other locations in the interior of the headbox. At such locations where there is a relatively low flow velocity for the stock dirt of other matter will begin to accumulate, even during perfectly normal types of operation, if the particular type of stock and other conditions are favorable for such contamination to take place.

In order to attempt to solve this problem it is known to utilize in a headbox flow channels shaped in order to achieve as much as possible a flow of stock which approaches as closely as possible to the ideal, and for this purpose such flow channels have ground or polished surfaces in order to achieve as great a smoothness as possible. Moreover, in paper mills it is known to utilize suitable additives in the pulp stock such as, so-called anti-slime agents.

However, even though attempts of the above type have been made to reduce the tendency of contaminating deposits to buildup at certain locations in the interior of the headbox, the desired results have not always been achieved. In fact it is necessary from time to time to completely shut down the paper machine only for the purpose of cleaning the headbox.

SUMMARY OF THE INVENTION

It is accordingly a primary object of the present invention to provide a structure which will avoid the above drawbacks.

In particular, it is an object of the present invention to provide a structure for effectively opposing the tendency of matter such as fibers, fillers, slime, or the like, to accumulate undesirably in the interior of the headbox.

Yet another object of the present invention is to provide a structure which will not only keep the interior of a headbox far cleaner than has heretofore been possible but which will in addition contribute to the homogeneity of the stock which flows through the headbox.

In accordance with the invention, at any location in the headbox where there is a tendency for matter such as fibers, fillers, slime, dirt, or the like, to accumulate, steam is introduced into the stock flowing in the headbox, this steam being introduced for example by way of suitable hollow bodies situated at locations of the above type where accumulations of the above type tend to occur. The hollow bodies have walls, such as sintered walls, formed with passages, such as those defined between the sintered particles, through which steam can flow from the interior to the exterior of the hollow bodies, and the interior of the hollow bodies communicate with a suitable supply of steam.

Steam which is introduced in this way into the stock flowing in the headbox has, of course, a temperature substantially higher than the temperature of the stock so that as a result the steam will condense in the stock. The steam forms bubbles in the stock and the stock which is relatively cold as compared to the steam causes a rapid condensation of the steam bubbles with the result that implosion takes place, accompanied by a pressure shock. These pressure shocks efficiently push the stock particles about, at the location where the steam is introduced, so as to prevent the stock particles from accumulating or becoming lodged at the locations where the steam is introduced, and in this way contamination in the interior of the headbox is prevented while at the same time a more homogeneous stock is achieved.

BRIEF DESCRIPTION OF DRAWINGS

The invention is illustrated by way of example in the accompanying drawings which form part of this application and in which.

DESCRIPTION OF PREFERRED EMBODIMENTS

The present invention is of particular utility in connection with the latest types of headbox where the older rotating flow equalizers, such as perforated rolls, have been replaced by static members such as various pipe bundles, or groups of rigid or flexible lamellae which are situated adjacent each other to define between themselves spaces through which the stock flows. The latter type of headbox has a tendency to accumulate dirt and other matter on the impact surfaces or leading edges of the lamellae at the input side of the static flow equalizers, the stock flowing toward these leading edge regions of the lamellae. As a result of this tendency for accumulations to form at these particular locations, it has been necessary from time to time to wash the accumulations off. In the event that they are not washed off soon enough, these deposits grow to a relatively large size and simply collapse into the flowing stock causing a pronounced lack of homogeneity in the stock. As a result, defects if not actual rupture of the paper web take place, in the event that accumulations of this type become detached from the edge regions of the lamellae or from other edge regions in the interior of the headbox where accumulations of the above type form.

According to the invention the leading edge regions of the static flow equalizers, formed by lamellae, can advantageously be made of a sintered material and steam can be conducted through the sintered material so that the implosion of the resulting steam bubbles in the stock as set forth above will be produced to keep these locations in the interior of the headbox clean in the manner described above.

Figure 1:
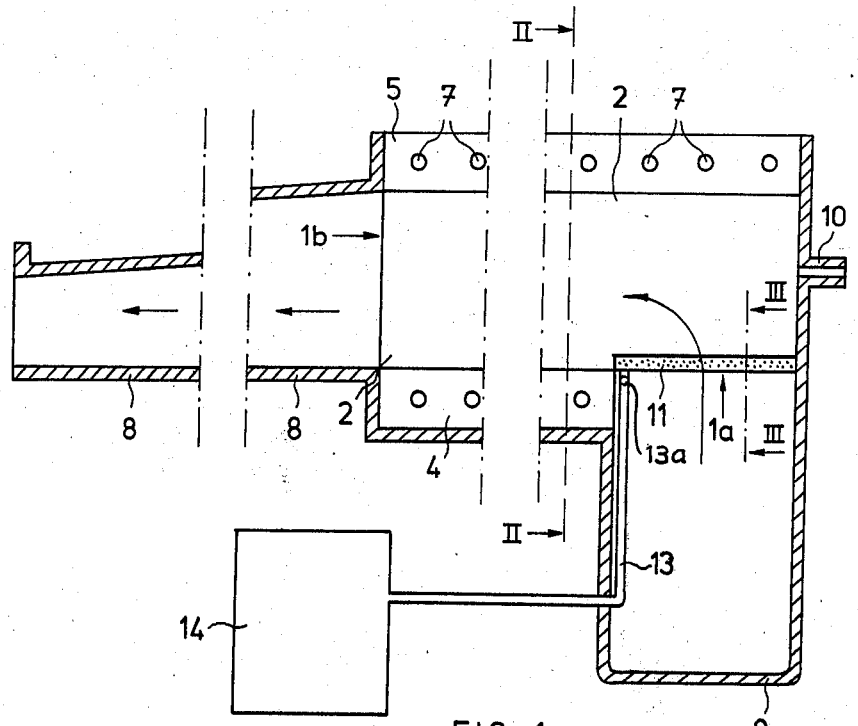
FIG. 1 is a schematic fragmentary sectional elevation of a headbox provided with the structure of the invention for carrying out the method of the invention.

Referring to the drawings, the headbox which is schematically illustrated in FIG. 1 includes an inlet region 9 to which stock is continuously supplied in a well known manner. This inlet region 9 extends across the entire width of the headbox, the width of the headbox extending perpendicularly with respect to the plane of FIG. 1. The stock which is thus introduced at the inlet 9 flows upwardly from the latter and then longitudinally through the interior of the headbox toward the left, as viewed in FIG. 1, so as to discharge from the aperture 8 of the headbox. A plurality of water-supply connections 10 are provided for the headbox at the right wall thereof, as viewed in FIG. 1.

Figure 2:
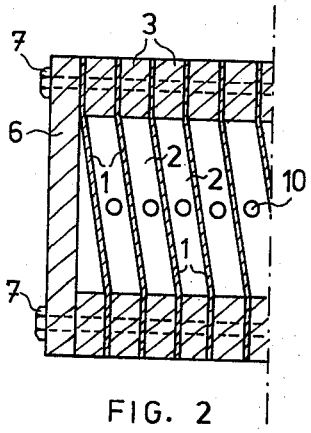
FIG. 2 is a fragmentary sectional elevation taken along line II—II of FIG. 1 in the direction of the arrows.

The illustrated headbox is provided in its interior with flow equalizers in the form of oblique lamellae 1 which define between themselves relatively narrow spaces or flow ducts 2. The width of these flow ducts 2 is determined by the dimensions of the spacers 3 situated between the lamellae 1. Thus, FIG. 2 shows how the lamellae extend obliquely from the upper to the lower spacers 3. These spacers are in the form of groups of upper and lower relatively long bars which alternate with the upper and lower edge regions of the lamellae 1. Relatively long tie bolts 7 serve to compress the upper and lower edge regions of the lamellae 1 between the several elongated spacers 3 as well to connect the side walls 6 of the headbox to the groups of upper and lower spacers 3 as well as the groups of upper and lower edge regions of the lamellae 1 situated between the spacers 3 in the manner shown most clearly in FIG. 2. As a result it will be seen that the headbox has an upper wall 5 formed by the upper group of spacers 3 and lamellae clamped therebetween as well as a lower wall 4 formed by the lower group of spacers 3 and the lower edge regions of the lamellae clamped therebetween.

As may be seen from FIG. 1, the stock which enters through the transversely extending inlet 9 tends to flow upwardly toward the leading edge regions 1*a* of the lamellae 1. As is apparent from FIG. 1 each lamella 1 has an elongated leading edge 1*a* extending across the entire inlet 9 with the several leading edge regions 1*a* being distributed throughout the width of the headbox. Thus, the stock will enter into the relatively narrow spaces or flow paths 2 defined between the lamellae, as indicated in FIG. 2 where the several water-supply connections 10 are also illustrated respectively communicating with the spaces 2. The stock will now flow through the elongated spaces 2 defined between the lamellae toward the trailing edge regions 1*b* of the lamellae, these edge regions 1*b* being apparent in FIG. 1 and being considered trailing in the sense that the stock flows past and beyond these trailing edge regions 1*b* of the several lamellae 1.

Figure 3:
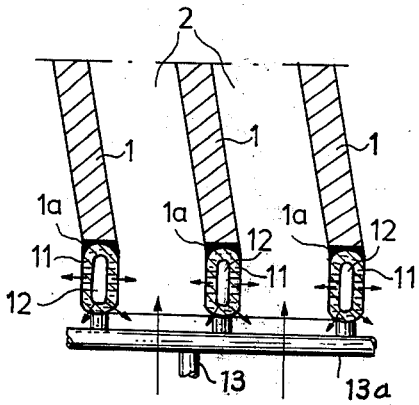
FIG. 3 is a sectional elevation fragmentarily illustrating part of the structure of FIG. 1, taken along line III—III of FIG. 1 in the direction of the arrows, and showing the structure at a scale which is enlarged as compared to FIG. 1.

With a headbox of the above construction there is a pronounced tendency for deposits to accumulate along the leading edge regions 1*a* of the lamellae 1. Such accumulation tends to take place along the entire length of each leading edge region 1*a* which extends across the entrance 9 of the headbox, in the manner illustrated in FIG. 1. In order to prevent such accumulation from occurring as well as to achieve other advantages of the invention, each leading edge region 1*a* has fixed thereto, along its entire length, an elongated hollow body 11 in the form of a tube having in cross section the configuration illustrated in FIG. 3. Thus, the several hollow bodies or elongated nozzle tubes 11 are welded to the leading edge regions 1*a* in the manner illustrated in FIG. 3. Each elongated hollow body 11 has a hollow interior space 12 forming an internal steam flow passage for each body 11. Moreover, the wall of each body 11, this wall surrounding the internal space 12, is formed with small holes or passages through which steam can discharge through the wall of each body 11 from the interior 12 thereof to the exterior into the stock flowing through the headbox. These passages are achieved by constructing each elongated hollow body 11 by way of sintered particles, or a different type of porous material may be used for each body 11. Thus, as a result of this construction the wall of the body is formed, between the sintered particles, for example, with passages through which steam can escape from the interior to the exterior of the body 11.

In the example illustrated in FIG. 1, at their left end regions, each elongated hollow body 11 has its interior in communication with a small tube which in turn communicates with an elongated header 13*a* extending across the entire headbox, and this header 13*a* communicates through a pipe 13 with a steam-supply means in the form of a steam-generating unit 14 schematically illustrated in FIG. 1. Of course the pipe 13 extends in a fluid-tight manner through the wall of the headbox which forms the inlet 9 thereof. Thus, by way of the steam-supply means 13, 14 it is possible to supply steam directly to the interiors 12 of the hollow bodies 11 with this steam then escaping from the interiors of the hollow bodies 11 through the passages formed in the walls of the hollow bodies into the stock forming in the latter steam bubbles which rapidly condense and create the implosion and resulting pressure shocks which achieve the results of the invention.

Of course, in addition to keeping the interior of the headbox clean by preventing deposits from accumulating as described above, the structure of the invention will also contribute to the homogeneity of the stock as a result of the prevention of detachment of clumps of deposits from locations such as edge regions of lamellae.

It is also possible to arrange the structure of the invention along the trailing edge regions 1*b* of the lamellae 1. Thus, hollow bodies 11 communicating at their interiors also with a steam supply means may be fixed to the edge regions 1*b* extending longitudinally therealong in the same way as these bodies 11 are fixed to the leading edge regions 1*a*, or a different but equivalent nozzle tube structure may be provided at the trailing edge regions 1*b* so as to prevent accumulation of contaminating deposits at the edge regions 1*b* as well as for contributing to the homogeneity of the stock which flows past the trailing edge regions 1*b*. It is also possible to situate the structure of the invention at other locations in the headbox where there is a tendency for deposits to accumulate, so that steam may be introduced at these additional locations to achieve the results of the invention as set forth above.

Thus, it will be seen that according to the present invention the desired results are achieved by the phenomenon according to which the stock flow, which is cold as compared to the steam delivered to the stock, causes condensation of the steam bubbles discharging from the nozzles or tubes at the small openings thereof. Therefore, the well known implosion phenomenon will result with the accompanying pressure shock, and these implosions and pressure shocks are utilized in accordance with the invention to keep the interior surfaces of the headbox clean as well as to contribute to the homogeneity of the stock.

I claim:

1. In a paper machine, a headbox having in its interior a location where there is a tendency for accumulation and build-up of matter such as fibers, fillers, slime and the like, and means situated in the region of said location for introducing steam into stock flowing through the headbox so as to oppose the tendency of said matter to accumulate and build-up at said location, said means including at the region of said location a plurality of hollow bodies each having a wall surrounding a hollow interior space and formed at least in part with passages through which steam can flow from the interior space to the exterior of each hollow body, and steam-supply means communicating with the hollow interior of each body for supplying thereto steam to flow through said passages to the exterior of each body into stock situated at the exterior of said body, said headbox having in its interior a plurality of flow-equalizing lamellae which define between themselves spaces through which the stock flows, and said lamellae respectively having leading edge regions toward which the stock flows and trailing edge regions away from which the stock flows, and said plurality of hollow bodies, respectively being connected with said lamellae and extending along one of said edge regions thereof for introducing steam into the stock at the region of said one of said edge regions of said lamellae.

2. The combination of claim 1 and wherein the wall of at least one of said hollow bodies has at least in part a sintered construction which provides between particles of said sintered construction which are sintered together said passages through which steam flows from the interior to the exterior of said body.

3. The combination of claim 1 and wherein said bodies extend along said leading edge regions of said lamellae.

* * * * *